US009655428B2

(12) United States Patent
Byun et al.

(10) Patent No.: US 9,655,428 B2
(45) Date of Patent: May 23, 2017

(54) EPILATING DEVICE HAVING OPEN CONFIGURATION

(71) Applicant: KONINKLIJKE PHILIPS N.V., Eindhoven (NL)

(72) Inventors: Da-Mi Byun, Eindhoven (NL); Ingrid Hietbrink, Eindhoven (NL); Arthur Putzer, Eindhoven (NL); Roland Waldner, Eindhoven (NL); Franciscus Jozef Marie Starmans, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 251 days.

(21) Appl. No.: 14/426,518

(22) PCT Filed: Sep. 2, 2013

(86) PCT No.: PCT/IB2013/058219
§ 371 (c)(1),
(2) Date: Mar. 6, 2015

(87) PCT Pub. No.: WO2014/041459
PCT Pub. Date: Mar. 20, 2014

(65) Prior Publication Data

US 2015/0237986 A1 Aug. 27, 2015

Related U.S. Application Data

(60) Provisional application No. 61/701,751, filed on Sep. 17, 2012.

(51) Int. Cl.
*A61B 17/50* (2006.01)
*A45D 26/00* (2006.01)

(52) U.S. Cl.
CPC .... *A45D 26/0028* (2013.01); *A45D 2026/009* (2013.01)

(58) Field of Classification Search
CPC ..... A45D 26/0023; A45D 26/0033; A45D 26/0038; A45D 26/0042; A45D 26/0047; (Continued)

(56) References Cited

U.S. PATENT DOCUMENTS 1,519,504 A 12/1924 Pando
4,726,375 A 2/1988 Gross
(Continued)

FOREIGN PATENT DOCUMENTS

EP 0532106 B1 3/1993
EP 1707326 A1 10/2005
(Continued)

*Primary Examiner* — Jonathan Miles

(57) ABSTRACT

An epilating device (1) has a housing (2) defining a handle (4) and first and second shoulder portions (6, 8) forming an open jaw (10). A tweezer portion (12) is mounted in the jaw (10) for rotation about its axis such that an opening (20) is formed through the device (1) from a front side (22) of the housing (2) to a rear side (24) of the housing (2), the opening (20) being bounded by the handle (4), the shoulder portions (6,8) and the tweezer portion (12). A drive mechanism (36) located within the housing (2) is arranged to apply rotational motion to rotate the tweezer portion (12) about the axis. By providing an opening (20) through the housing (2) of the epilator (1) from the front (22) to the rear side (24), collection of hair and debris beneath the tweezer portion (12) is avoided.

14 Claims, 5 Drawing Sheets

(58) Field of Classification Search
CPC ..... A45D 26/0052; A45D 26/0071; A45D 26/0076; A45D 26/00
See application file for complete search history.

(56) References Cited

U.S. PATENT DOCUMENTS

| | | | | |
|---|---|---|---|---|
| 4,807,624 | A | 2/1989 | Gross | |
| 5,207,689 | A * | 5/1993 | Demeester | A45D 26/0028 452/84 |
| 5,312,419 | A * | 5/1994 | Garenfeld | A22C 21/028 606/131 |
| 5,449,364 | A * | 9/1995 | Niedertscheider | A45D 26/0028 606/131 |
| 5,797,925 | A * | 8/1998 | Heintke | A45D 26/00 606/131 |
| 5,976,157 | A * | 11/1999 | Yiu | A45D 26/0028 425/71 |
| D438,341 | S | 2/2001 | Schneider | |
| 6,520,970 | B1 | 2/2003 | Sanchez-Martinez | |
| 7,582,094 | B2 | 9/2009 | Dorber | |
| 7,824,418 | B2 | 11/2010 | Liu | |
| 2004/0087973 | A1 * | 5/2004 | Shobeiri | A45D 26/0033 606/133 |
| 2005/0125008 | A1 | 6/2005 | Poran | |
| 2007/0239174 | A1 | 10/2007 | Yiu | |
| 2008/0172070 | A1 | 7/2008 | You | |

FOREIGN PATENT DOCUMENTS

| | | | |
|---|---|---|---|
| JP | 0489207 | U | 8/1992 |
| WO | 2006117755 | A1 | 11/2006 |

* cited by examiner

EPILATING DEVICE HAVING OPEN CONFIGURATION

This application is the U.S. National Phase application under 35 U.S.C. §371 of International Application No. PCT/IB2013/058219, filed on Sep. 2, 2013, which claims the benefit of U.S. Provisional Application No. 61/701,751 filed on Sep. 17, 2012. These applications are hereby incorporated by reference herein.

BACKGROUND OF THE INVENTION

Field of the Invention

The present invention relates to epilating devices and in particular to an improved configuration allowing improved cleaning of the tweezer portion.

Description of the Related Art

Epilating devices of many different types are known for the purpose of removing unwanted hair from various regions of a user's body. The principles of operation vary greatly but amongst these devices, a sizeable subgroup operates through the use of rotating tweezer-mechanisms which seize hairs and actively extract them from the skin/follicle. As the tweezer rotates further it releases the hair. In the present context, the term "tweezers" is used to denote an arrangement that is capable of opening and closing to grip and extract a hair or hairs.

One of the earliest devices of this type is the Epilady™ device, which uses the rotation of a coil spring to capture and release hairs. A number of similar devices exist in which the tweezer device comprises a flexible or resilient axle that can deform to follow the contours of a user's skin during use.

Other devices have been developed that use tweezer mechanisms, mounted on relatively rigid axles or shafts. The shafts may be straight or curved. Such devices may advantageously retain their shape e.g. when attempting to reach difficult locations such as concave body portions. One device is disclosed in EP532106B1, the contents of which are incorporated herein by reference in their entirety. That device uses rotating disks which are pivotable towards each other under the influence of a compression member. The rotating disks form a disk package and are carried by an axle which rotates between bearings carried by bearing support members at either end of the disk package. The compression member comprises roller members located within the bearing support members. The drive mechanism for rotating the disk package is also located in the regions of the bearing support members, which may be referred to as the shoulders of the device.

During epilation, the hairs that are extracted must be disposed of Existing designs of epilator have housings that at least partially surround the tweezer mechanism. Hairs tend to collect in the space between tweezers and housing and may be difficult to remove or be unsightly. For epilators used in intimate or sensitive regions, additional guards may be arranged around the active part of the tweezer mechanism. Such guards further increase the retention of the extracted hairs.

An additional problem that may be encountered during the design and use of an epilating device is that of skin pinching. In particular, for areas of soft or unsupported skin, the rotating tweezers can drag a fold of skin into the space between the tweezers and the housing. It is also possible for the tweezers themselves to nip the skin as they begin to close from their most open position.

In light of the above, it would therefore be desirable to produce an epilating device allowing good access to difficult regions of the body while ensuring a clean visual appearance and easy cleaning.

BRIEF SUMMARY OF THE INVENTION

According to the invention there is provided an epilating device for removing hairs from skin by pinching, pulling and releasing the hairs. The epilating device comprises a housing defining a handle and first and second shoulder portions extending from the handle and forming an open jaw there between. A tweezer portion having an axis, first and second ends, and at least one pair of tweezer elements is mounted to rotate about the axis during use and defines at least one pinching region at its circumference at which hairs may be pinched. The tweezer portion is mounted in the jaw with the first and second ends being supported by the respective first and second shoulder portions at a distance from the handle such that an opening is formed through the device from a front side of the housing to a rear side of the housing, the opening being bounded by the handle, the shoulder portions and the tweezer portion. A drive mechanism located within the housing is arranged to apply rotational motion to rotate the tweezer portion about the axis. By providing an opening through the housing of the epilator from the front to the rear side, collection of hair and debris beneath the tweezer portion is avoided. Importantly, due to the presence of the opening, skin cannot be trapped between the tweezer portion and the housing as the tweezer portion rotates.

Preferably, the "opening" is a free path or line of sight opening. It is at least understood to be more than a mere crack such as might be visible through a pair of tweezer elements in their open position. Nevertheless, it will be understood that a curved or bent opening having sufficient free passage may also achieve the effect of allowing hairs and debris to exit from beneath the tweezer portion while avoiding skin pinching.

Preferably the opening has a cross-section of more than 1 $cm^2$. The actual size of the opening will depend upon the overall size of the device, but will in general exceed 1 $cm^2$. Preferably, the opening will be at least 5 mm in height at its smallest dimension. This dimension is believed to be the lower limit at which pinching of the skin may be an issue. In general however, the opening may be at least 10 mm in height at the front side of the housing. Most preferably, the opening will extend across substantially the full width of the tweezer portion or at least across a width of the pinching region. Reference to "width" in the context of the present invention is intended to denote a direction generally parallel to the axis of the tweezer portion. Reference to "height" is intended to denote a direction that is radial to the tweezer portion. Reference to the front and rear sides of the housing is also not to be limited by any actual orientation of the device or housing in use, but is intended to correspond to the direction of rotation of the tweezer portion being such that the pair of tweezer elements moves from the rear side towards the front side at the location of the pinching region, i.e. towards the opening at the front side of the housing.

The opening also preferably has a width of at least half a maximum width of the housing. It will thus be understood that the open space between the shoulder portions is relatively wide compared to the width of the shoulder portions themselves.

As mentioned above, the preferred size of the opening is at least partially dependent upon the size of the device. In particular, the opening may preferably have a height that is at least equal to a radius of the tweezer portion and which may even correspond to a diameter of the tweezer portion. The tweezer portion preferably has a diameter of between 12 mm and 20 mm, most preferably around 15 mm.

The present device is believed to be particularly useful in the context of epilation in hard to reach and intimate locations. For such purposes, the tweezer portion preferably has a width to diameter ratio of less than 2, meaning that it has the form of a relatively squat cylinder. It may even have a width that is smaller than its diameter.

The opening may have any suitable shape to achieve its purpose. In one preferred embodiment, the open jaw is generally U-shaped with the shoulders extending from the handle portion in a jaw direction. The opening is D-shaped, with a straight side of the D-shape being formed by the tweezer portion. The resulting lower surface of the opening is thus relatively smooth, without sharp corners where debris can collect. The lower surface is also closed towards the interior of the housing such that the handle and first and second shoulders form an essentially closed housing, avoiding ingress of hairs and other debris. The housing may also be waterproof.

The invention is applicable to various types of epilating device, operating with different forms of tweezer portion. In a most preferred embodiment of the device, the tweezer portion comprises a plurality of disks having the tweezer elements at their outer circumference, the disks being mounted for rotation on the axis and biased such that the tweezer elements engage each other at the pinching region. It will be understood that this is equally applicable to cam based systems where the tweezer elements are operated e.g. by cam operated rods.

Preferably, the axis of the tweezer portion is rigid. In this context, rigid is understood to be within the normal tolerances expected of such components. The tweezer portion is thus not intended to adapt to the surface of the skin but should instead be able to be pushed into a convex corner of the body such that the skin is adapted to the tweezer portion.

In one embodiment, the invention is applicable to devices in which the axis of the tweezer portion is curved. The curve of the axis can thus determine the position of the pinching region. The precise location of the pinching region will depend upon the individual design and intended use of the epilator. Preferably, the shoulder portions extend from the handle to define a jaw direction and the curved axis may then lie in a plane that crosses the jaw direction at an angle of between 0° and 45° whereby the pinching region is defined at an upper front side of the housing. The jaw direction may be aligned with an axis of the handle portion but it will be understood that for ergonomic purposes, the jaw direction may be angled forwards or backwards with respect to the handle.

According to an important aspect of the invention, the epilating device may further comprising a spacer bar extending from the first shoulder portion to the second shoulder portion at the upper rear side of the housing. The spacer bar may thus join the free ends of the shoulder portions and overlies the tweezer portion at a position just ahead of the pinching region in the direction of rotation of the tweezer portion. In this way, it may be avoided that skin is pinched by the tweezer elements as they start to close. This is particularly important for devices for use in areas of relatively slack skin, where pressure of the epilating device may cause skin doming to occur. The bar may thus be used to relieve pressure of the skin from the tweezer portion. The spacer bar may have a depth measured in the circumferential direction of the tweezer portion of between 5 mm and 20 mm and preferably covers between 5° and 25° of the circumference. It will be understood that the bar should not restrict the opening and is thus also spaced from the handle with the opening passing between the bar and the handle. The bar may be either permanently attached to the housing or may also be removable by a user. In this manner, bars with different shapes, sizes and functionalities may be exchanged. The bar may be rigid or flexible and could also be embodied as a roller or carry roller elements along its length, in order to better follow the skin. The bar may also be provided with any number of additional functionalities, including but not limited to: friction reducing strips, friction increasing strips, brushes, knobbles and lotion applicators.

According to another aspect of the invention, the epilating device may also comprise a removable guard, attachable to the housing to at least partially cover the tweezer portion. The guard can operate in a similar manner to the bar described above in that it may reduce pinching of the skin by the tweezer portion. It may also serve to reduce the operational opening of the device for more accurate operation. The guard may locate over various portions of the tweezer portion, in particular, it may cover all or part of the pinching region.

In one preferred embodiment, the guard covers the opening at the front side of the housing. In general it will leave the opening free at the rear side of the housing so that debris can escape. Nevertheless, it will be understood that the guard may also cover both sides of the opening. In this manner a chamber is formed in the opening under the guard, where hair can collect. On removal of the guard, the hair and debris can easily be emptied out.

Most preferably, the guard comprises slots or holes, allowing hairs to protrude there through for engagement by the tweezer elements. The slots or holes may be wide or narrow, long or short but will generally be aligned with the direction of rotation of the tweezer portion. For a tweezer portion comprising a plurality of rotating disks, slots may be provided aligned with gaps between the disks forming the tweezer elements.

The guard is preferably removable from the housing. This may be achieved by mechanically clipping the guard to the housing. If a spacer bar is provided, the guard may be clipped or otherwise connected to the bar. Alternatively, the guard may be magnetically attached to the housing or bar.

BRIEF DESCRIPTION OF THE DRAWINGS

The features and advantages of the invention will be further appreciated upon reference to the following drawings of a number of exemplary embodiments, in which.

DESCRIPTION OF ILLUSTRATIVE EMBODIMENTS

Figure 1:
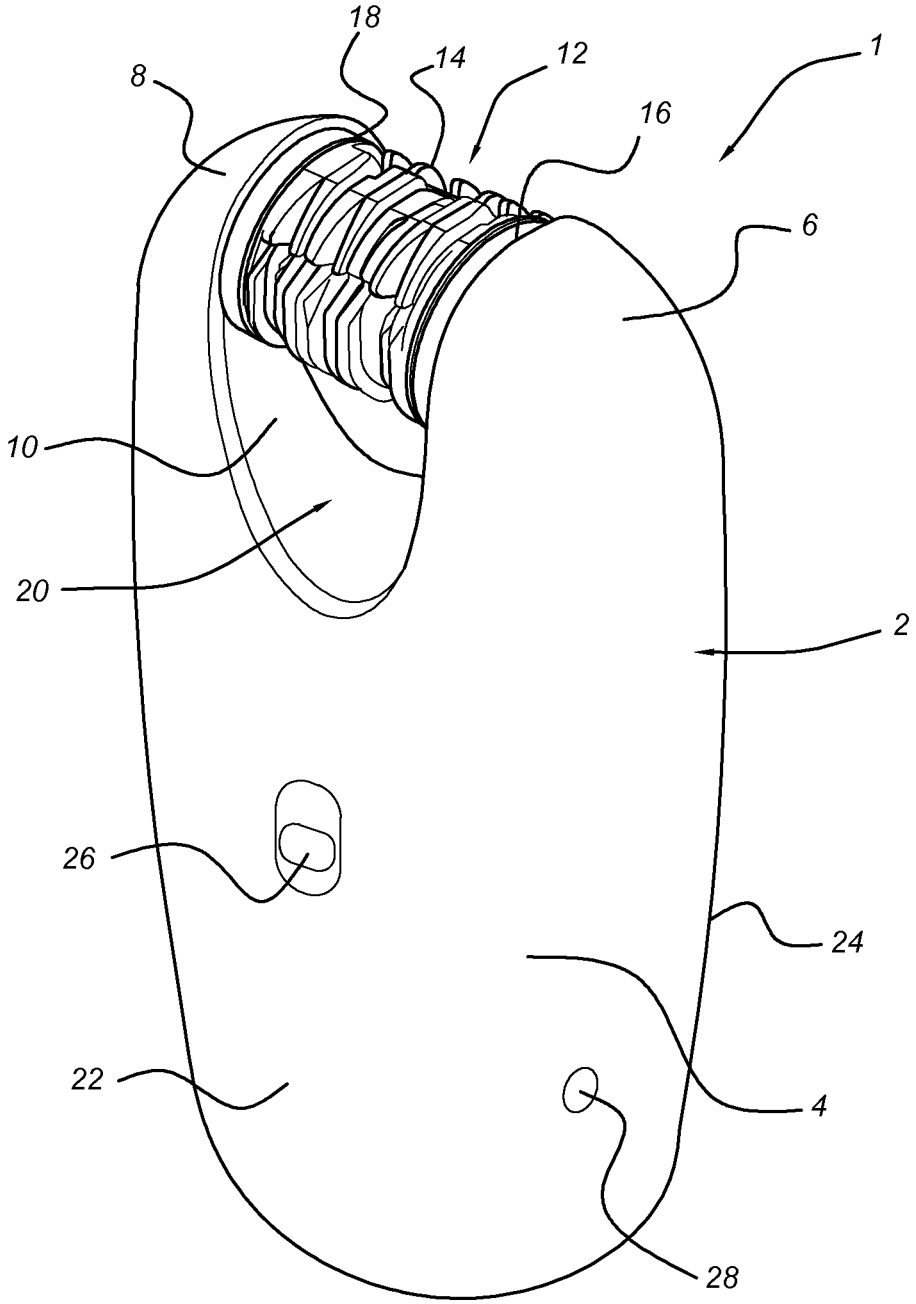
FIG. 1 shows an epilating device according to a first embodiment of the present invention in perspective view.

FIG. 1 shows a perspective view of an epilating device 1 according to a first embodiment of the invention. The epilating device 1 comprises a housing 2 defining a handle 4 and first and second shoulder portions 6, 8 extending from the handle and forming an open jaw 10 there between. A tweezer portion 12 comprising a plurality of tweezer elements 14 is mounted for rotation within the jaw 10. The tweezer portion 12 has first and second ends 16, 18 which are supported by the first and second shoulder portions 6, 8 respectively. The tweezer portion 12 is mounted at a distance from the handle 4 such that an opening 20 is formed through the device 1 from a front side 22 of the housing 2 to a rear side 24. The handle 2 is also provided on its front side 22 with an actuation switch 26 and contacts 28 for the purpose of recharging.

Figure 2:
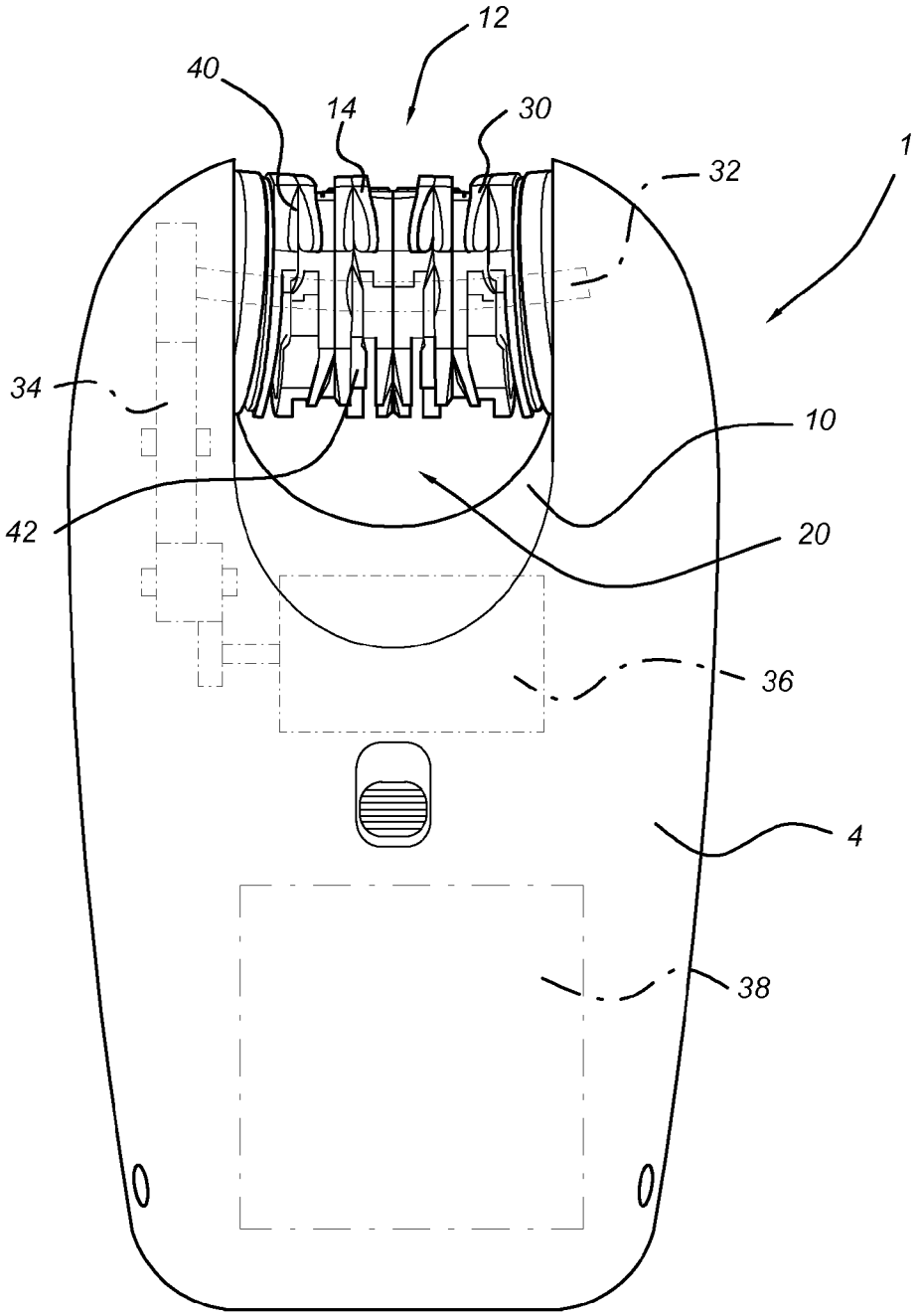
FIG. 2 shows a front view of the epilating device of FIG. 1.

FIG. 2 shows a front view of the device 1 of FIG. 1. As can be seen, the tweezer portion 12 comprises a plurality of disks 30 having the tweezer elements 14 formed at their outer circumferences. The disks 30 are supported by a shaft 32 and driven by appropriate transmission 34 located within the housing 2. Also indicated by broken lines within the housing are motor 36 and rechargeable battery 38. The shaft 32 is slightly curved, causing the disks 30 to converge at a pinching region 40 formed slightly towards the front side 22 of the housing 2 within the jaw 10. The disks 30 diverge again at a releasing region 42 formed within the opening 20. Further details of the operation of the tweezer portion 12 can be found in WO2006/117755A1, the contents of which are incorporated herein by reference in their entirety. Although the invention is described in relation to a disk based tweezer portion, it will be understood that the principle applies equally to any similar tweezer mechanism that can achieve the required pinching and pulling of hairs. During operation, the rotating tweezer portion 12 is brought into contact with the skin of a user. Hairs are grasped at the pinching region 40 and pulled out from the skin as the tweezer portion 12 rotates further. In prior designs in which the tweezer portion is recessed in a housing, the hairs rotate downwards into the housing recess before release. According to the present design, the releasing region 42 is located at the opening 20 and on release, the hairs are free to fall away from the tweezer portion 12. Since the opening 20 formed between the handle 4 and the tweezer portion 12 is relatively large, even relatively long or springy hairs can escape and the device can easily be kept clean. Furthermore, because of the open space between the tweezer portion 12 and the handle 4, skin folds cannot be nipped at this position.

Figure 3:
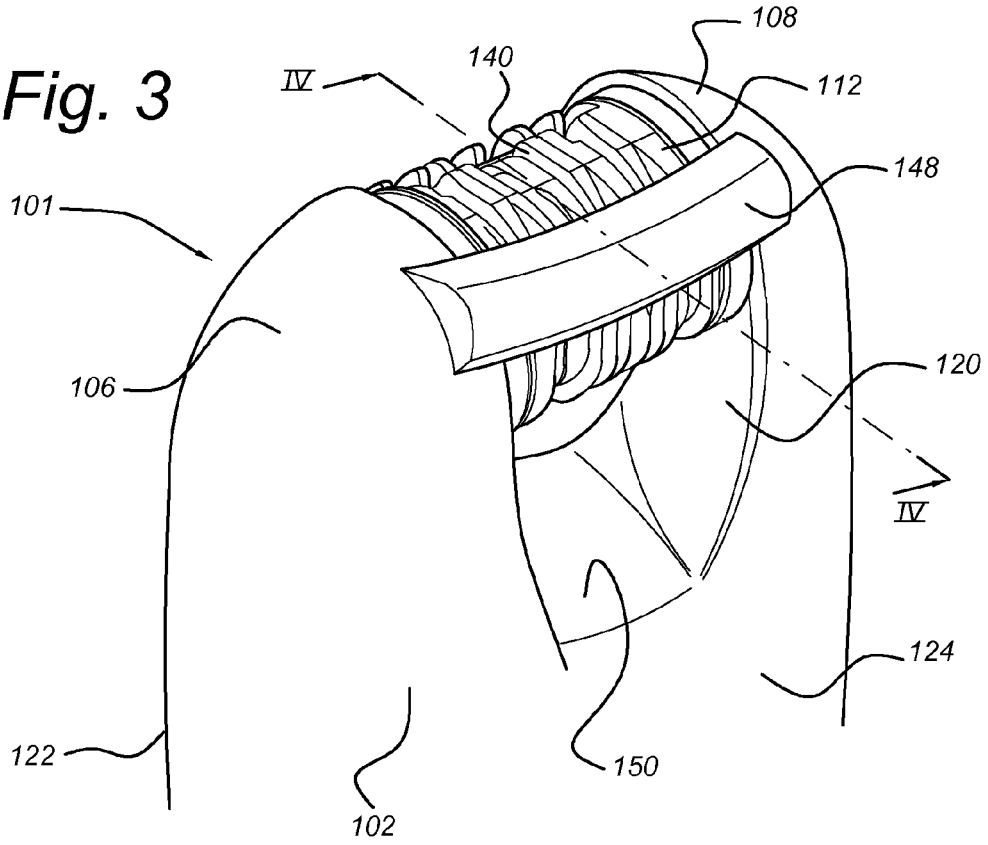
FIG. 3 shows a perspective view of an alternative embodiment of the invention.

FIG. 3 shows a rear perspective view of the upper portion of a device 101 according to a second embodiment of the invention. Like elements to the first embodiment are hereby assigned the same reference numeral preceded by 100.

The device 101 of the second embodiment differs from the first embodiment by the presence of a spacer bar 148, provided on the upper rear side 124 of the housing 102, spanning from the first shoulder portion 106 to the second shoulder portion 108. The bar 148 is spaced slightly from the tweezer portion 112 and located at a position slightly ahead of the pinching region 140 in the direction of rotation R of the tweezer portion 112. The device 101 also differs in that the opening 120 at the rear side 124 of the housing 102 is larger than at the front side 122 so that the lower surface 150 of the opening 120 slopes downwards towards the rear side 124.

Figure 4:
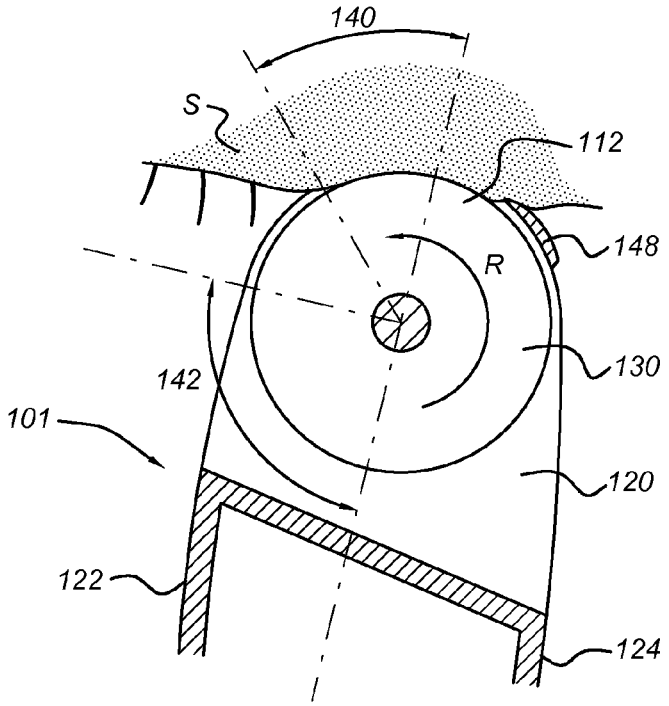
FIG. 4 shows a cross-section through the epilating device of FIG. 3 in direction IV-IV.

FIG. 4 shows a cross-sectional view through the device 101 of FIG. 3, taken along line IV-IV during use, with the device 101 in contact with the skin S. In this view, the pinching region 140 is shown covering an angle of around 45°. Following the pinching region 140 in the direction of rotation R is the releasing region 142. As will be understood, the pinching region 140 is denoted as such as being the area at which hairs are pinched. Nevertheless, prior to the pinching region 140, the tweezer elements 114 of the disks 130 are starting to close and can already trap folds of skin e g if pressure is exerted. The bar 148 effectively covers the part of the tweezer portion 112 where skin pinching could otherwise occur. Additionally, the bar 148 provides a guide for users during use and serves to space the tweezer portion 112 from the skin S.

Figure 5:
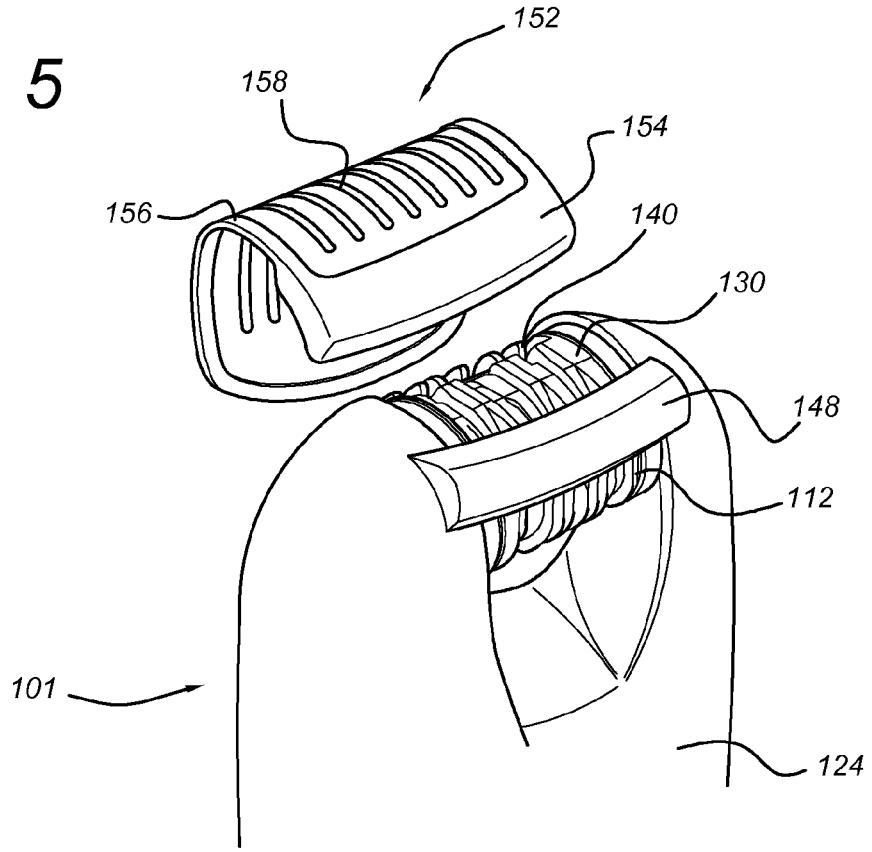
FIG. 5 shows the device of FIG. 3 provided with a guard.

FIG. 5 shows a perspective view of the device 101 of FIG. 3 viewed from the rear side 124 and provided with a guard in the form of a cap 152. The cap 152 is in the shape of a plastic frame 154 carrying a metal foil 156, which substantially covers the pinching region 140. The foil 156 has slots 158 extending parallel to the disks 130 of the tweezer portion 112. The cap 152 provides additional control over the epilating procedure and limits the exposed region of the tweezer portion 112 to the slots 158. This makes the device 101 much easier to use in restricted areas where skin folds can otherwise become pinched.

Figure 6:
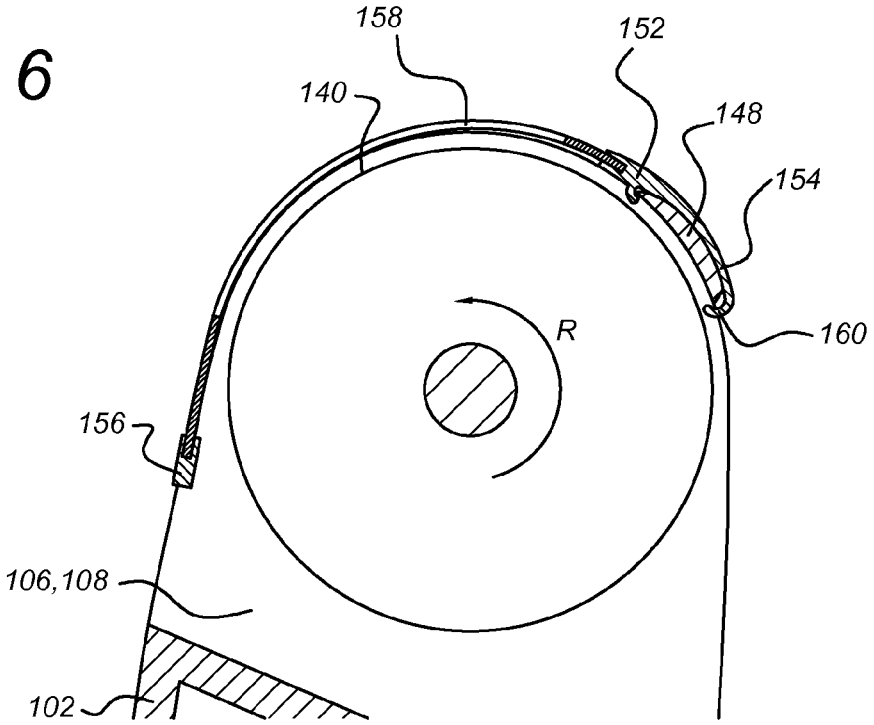
FIG. 6 shows the device of FIG. 5 in cross-section along line VI-VI.

FIG. 6 shows a cross section similar to FIG. 4 illustrating the manner in which the cap 152 is retained over the pinching region 140. As can be seen, the frame 154 has a clip 160 at its rear side, which engages with bar 148. The frame 154 is resilient and is flexed into engagement with the shoulders 106, 108. The skilled person will well recognize that additional fixation elements may be provided on the housing 102 to hold the frame in place.

Figure 7:
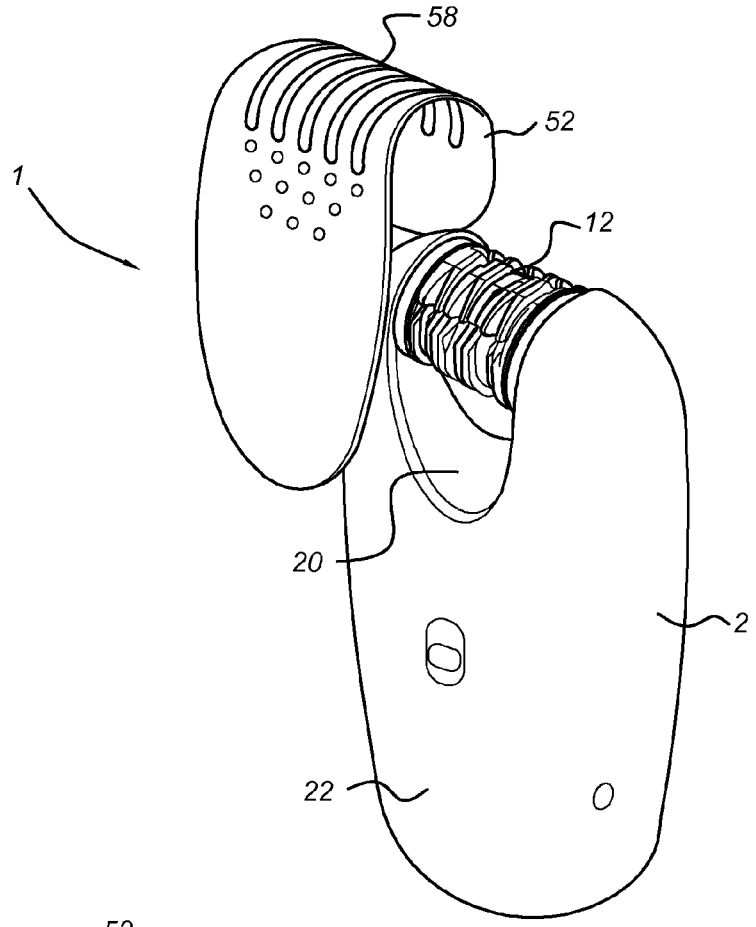
FIG. 7 shows a perspective view of the device of FIG. 1 provided with a guard.

FIG. 7 shows an alternative guard 52 that can be applied to the device 1 of the first embodiment. This guard 52 extends further over the front side 22 of the housing 2 and completely covers the opening 20. As in the case of the cap 152 of FIG. 5, the guard 52 has slots 58 through which the hairs can be engaged by the tweezer portion 12. In this embodiment, the guard 52 is formed of magnetic material and is held to the housing 2 by magnetism.

Figure 8:
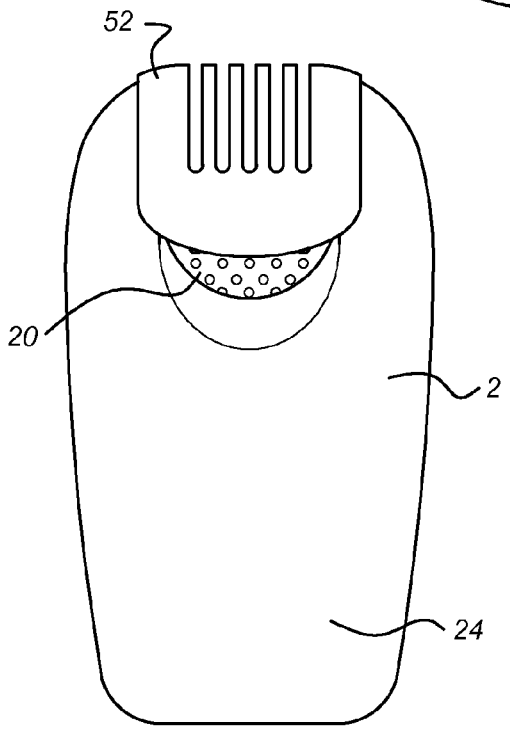
FIG. 8 is a rear view of the device of FIG. 7.

FIG. 8 shows the device of FIG. 1 from the rear side 24, with the guard 52 in position. As can be seen, the opening 20 is exposed at the rear side 24 of the housing 2, such that pulled hairs can exit. The skilled person will understand that the guard 52 can also close the rear side of the opening to form a closed chamber for collection of hairs.

Thus, the invention has been described by reference to certain embodiments discussed above. It will be recognized that these embodiments are susceptible to various modifications and alternative forms well known to those of skill in the art. In particular, the construction of the tweezer portion may be distinct from the schematically illustrated design.

Many modifications in addition to those described above may be made to the structures and techniques described herein without departing from the spirit and scope of the invention. Accordingly, although specific embodiments have been described, these are examples only and are not limiting upon the scope of the invention.

The invention claimed is:

1. An epilating device for removing hairs from skin by pinching, pulling and releasing the hairs, comprising:

a housing defining a handle and first and second shoulder portions extending from the handle and forming an open jaw there between;

a tweezer portion having first and second ends and at least one pair of tweezer elements, the tweezer portion being mounted to rotate about an axis during use and defining at least one pinching region at its circumference at which hairs may be pinched, the tweezer portion being mounted in the jaw with the first and second ends being supported by the respective first and second shoulder portions; and a drive mechanism located within the housing and arranged to apply rotational motion to rotate the tweezer portion about the axis;

wherein the tweezer portion is mounted between the shoulder portions at a distance from the handle such that an opening is formed through the device from a front side of the housing to a rear side of the housing, the opening being bounded by the handle, the shoulder portions and the tweezer portion, wherein the opening has a height in a direction radial to the tweezer portion that is at least equal to a radius of the tweezer portion.

2. The device according to claim 1, wherein the tweezer portion has a diameter and a width in a direction parallel to the axis, wherein a ratio between the width and the diameter is less than 2.

3. The device according to claim 1, wherein the open jaw is generally U-shaped and the opening is D-shaped, with a straight side of the D-shape being formed by the tweezer portion.

4. The device according to claim 1, wherein the axis is rigid.

5. The device according to claim 1, wherein the axis is curved.

6. The device according to claim 5, wherein the shoulder portions extend from the handle to define a jaw direction and the curved axis lies in a plane that crosses the jaw direction at an angle of between 0° and 45° whereby the pinching region is defined at the front side of the housing.

7. The device according to claim 1, further comprising a spacer bar extending from the first shoulder portion to the second shoulder portion at the rear side of the housing.

8. The device according to claim 1, further comprising a removable guard, attachable to the housing to at least partially cover the tweezer portion.

9. The device according to claim 8, wherein, in the attached position, the guard covers the opening at the front side of the housing.

10. The device according to claim 8, wherein the guard comprises slots or holes, allowing hairs to protrude there through for engagement by the tweezer elements.

11. The device according to claim 8, wherein the guard is mechanically clipped to the housing.

12. The device according to claim 8, wherein the guard is magnetically attached to the housing.

13. The device according to claim 8, further comprising a spacer bar extending from the first shoulder portion to the second shoulder portion at the rear side of the housing, wherein the guard is attached to the spacer bar.

14. The device according to claim 1, wherein the tweezer portion comprises a plurality of disks having the tweezer elements at their outer circumference, the disks being mounted for rotation on the axis and biased such that the tweezer elements engage each other at the pinching region.

* * * * *